United States Patent [19]

Weakly

[11] 4,289,310

[45] Sep. 15, 1981

[54] SWING APPARATUS

[76] Inventor: Terence S. Weakly, 701 E. King, Kingsville, Tex. 78363

[21] Appl. No.: 87,141

[22] Filed: Oct. 22, 1979

Related U.S. Application Data

[63] Continuation of Ser. No. 838,621, Oct. 3, 1979, abandoned.

[51] Int. Cl.[3] ..... A63G 9/00

[52] U.S. Cl. ..... 272/85

[58] Field of Search ..... 272/85, 87, 86, 88, 272/89, 90, 91, 92; D34/5 M; 297/273, 274, 275, 276, 277, 278, 279, 280

[56] References Cited

U.S. PATENT DOCUMENTS

| | | | |
|---|---|---|---|
| Re. 25,677 | 11/1964 | Grudoski | 272/85 |
| 439,648 | 11/1890 | Franklin | 272/92 |
| 1,252,133 | 1/1918 | Martin | 297/274 |
| 1,379,082 | 5/1921 | Cavanaugh | 297/280 |
| 2,225,737 | 12/1940 | Vaney | 272/85 |
| 3,401,978 | 9/1968 | Wrigglesworth | 297/274 |
| 4,017,071 | 4/1977 | Wright | 272/85 |
| 4,116,433 | 9/1978 | Koemer | 272/85 |

FOREIGN PATENT DOCUMENTS

| | | | |
|---|---|---|---|
| 568775 | 1/1959 | Canada | 297/275 |
| 657561 | 9/1951 | United Kingdom | 297/275 |

*Primary Examiner*—Richard C. Pinkham
*Assistant Examiner*—T. Brown

[57] ABSTRACT

A swing apparatus for amusement and exercising having an upper single support cable for securing to an overhead support and having spaced support cables secured with the lower end of the single support cable through a spacer connection and universal connector means and having a swing seat secured to the lower ends of the spaced support cables.

1 Claim, 3 Drawing Figures

SWING APPARATUS

This is a continuation of application Ser. No. 838,621 filed Oct. 3, 1977, now abandoned.

BACKGROUND OF THE INVENTION

This invention related generally to swinging devices for amusement and exercising. In particular, the invention is directed to a swinging device for attaching to a stationary support which allows an individual to swing or oscillate back and forth and universally at the same time.

Swing devices which are attached to an overhead support are well known in the art. These devices range from the well known swing comprising a rope or cable attached to an overhead support and having the lower end of the rope or cable tied to a conventional vehicle tire. Another type of known swing is a bag swing which replaces the tire described above with a burlap bag or the like which is filled with a generally resilient material so that an individual may grip their legs around the bag while hanging on to the rope or cable with the bag acting as a seat portion.

Also well known in the art are conventional swing sets which are commonly found in playgrounds and in home use which comprise two parallel chains, ropes or cables suspended from an overhead support and secured at their lower ends to a horizontally extending flat seat member.

Examples of some swing devices are found in U.S. Pat. Nos. 3,186,711; 3,466,033; 3,838,854; 3,966,202; 4,014,540; 4,017,071.

So far as known, a swing device which is simple, inexpensive, easily constructed and manufactured from available components and which provides the features of allowing an individual using the device to swing back and forth and also provides controlled universal movement at the same time has not heretofor been known. Various types of mechanical mechanisms or constructions are available to provide the combination feature of swinging back and forth and universal movement. However, to be commercially and economically feasible such devices should be constructed of components which may be readily fabricated at a low cost and still retain all the desired capabilities. The swing must also be very safe since any failure of the swing or loss of control during its use could result in serious injury to an individual using the same. It is necessary to provide a construction which is strong and not prone to any failures due to breaking of the apparatus.

SUMMARY OF THE INVENTION

A new and improved swing device having a single cable which is attached at its upper end to an overhead support and which extends downwardly to a swivel connector member attached at the lower end of the single cable. The lower portion of the swing comprises a seat member and includes two spaced cables secured to opposite sides of the seat and extending upwardly therefrom a predetermined distance, to a swivel cross-member. In an alternative construction, a single rope chain cable or the like is secured with one side of the seat and extends upwardly to a V-shaped cross-member which may be formed of high strength spring steel or the like with the V portion attached to the single cable through a swivel and the legs of the V extending downwardly therefrom. Another cable is secured to the other side of the seat and extends upwardly and is secured with the other end of the V shaped cross-member.

DETAILED DESCRIPTION OF THE PREFERRED EMBODIMENTS

Figure 1:
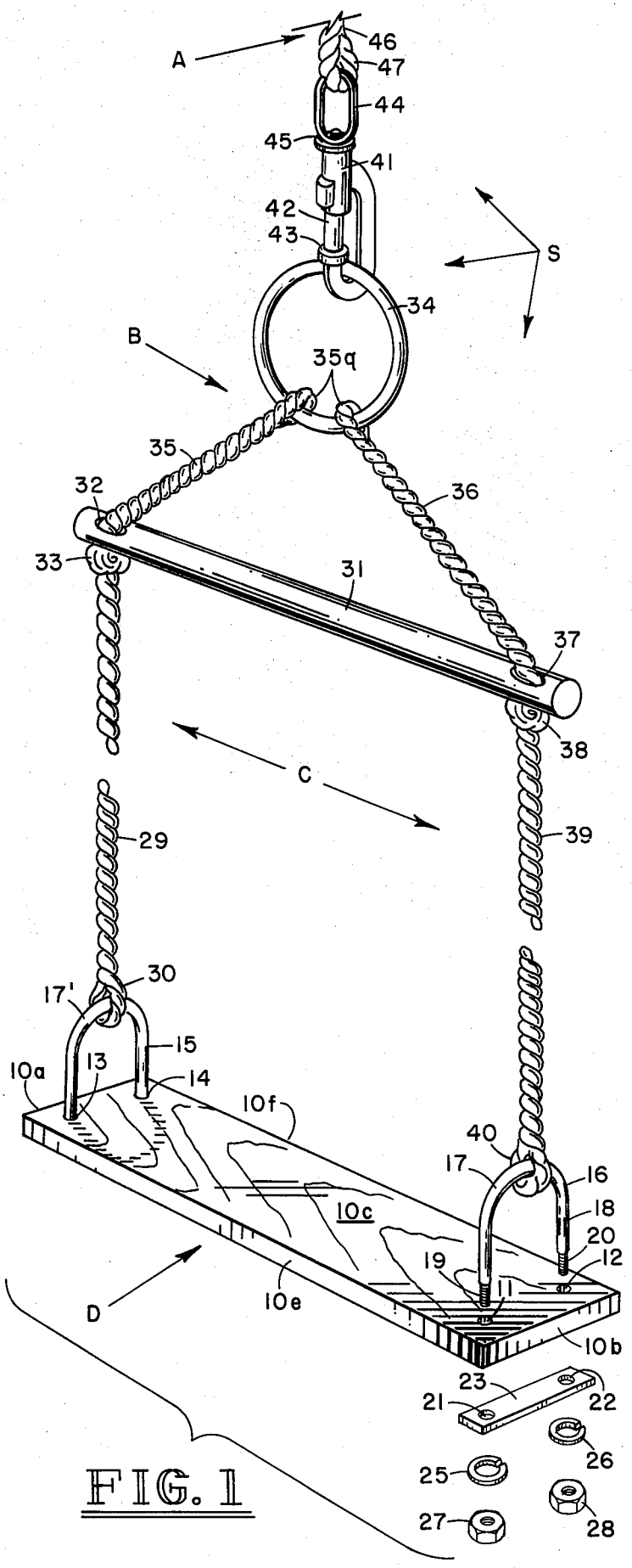
FIG. 1 is a perspective view, partially exploded, of the swing device showing one embodiment of this invention.

With reference to FIG. 1 of the drawings, there is shown a swing device in accordance with the invention. The apparatus is generally designated by S and generally includes a single cable A, swivel cross-member means B, spaced parallel cable C and seat means D.

Figure 2:
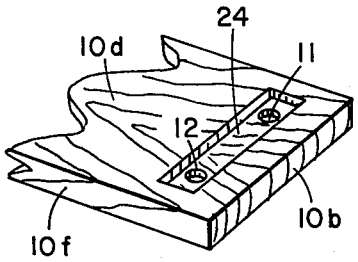
FIG. 2 is a perspective view, partially broken away, showing the lower side of the seat member as it would appear looking upwardly in FIG. 1.

The swing device is shown having a seat member 10 which is generally rectangular in shape and may be formed of any suitable material such as metal reinforced plastic wood or the like. Adjacent the opposite ends 10*a* and 10*b* of the seat member 10 are openings 11, 12, 13 and 14 which extend through the seat member from its upper surface 10*c* to its lower surface 10*d* as best shown in FIG. 2. The seat member 10 also includes edges 10*e* and 10*f* (not shown).

Extending through the openings 13 and 14 is a U-shaped connector 15. A similar U-shaped connector 16 is designed to extend through the openings 11 and 12. The exploded portion at the right hand side of FIG. 1 shows the U-shaped connector 16 as having leg portions 17 and 18 having conventional threaded ends 19 and 20. The threaded ends 19 and 20 extend through the openings 11 and 12 respectively and through openings 21 and 22, respectively, in reinforcing strap member 23. As best shown in FIG. 2, the lower surface 10*d* of the seat member includes a rectangular recessed portion 24 which generally has the same dimensions as the strap member 23 so that the strap member will fit into the recess portion 24 to secure it therewith. The depth of the recess portion 24 may be such that the strap member 23 is flush with the surface 10*d* when in position. The primary purpose of the strap member is for reinforcing and in the case where the seat member is made up of sufficiently strong material it may be possible to dispense with the reinforcing strap member 23. As also shown in FIG. 1, conventional lock washers 25 and 26 are provided for positioning on the threaded ends 19 and 20 respectively and conventional nuts 27 and 28 are also provided for screwing on the threaded ends 19 and 20 respectively.

Attached to the cross portion 17' of the U-shaped connector 15 is a flexible cable member 29. Cable member 29 is preferably formed of synthetic or natural fibers such as sisal or nylon rope. Other suitable flexible materials such as steel cables, chains or the like may be substituted for the cable member 29.

A loop 30 is formed at one end of the cable 29 by suitable means such as interweaving of the ends of the cable as is well known in the cable making art. If desired a suitable reinforcing member may be inserted in the loop 30 such as typically used for a lariat. The U-shaped member 15 may be inserted through loop 30 which may be preformed.

The cable 29 extends upwardly to a cross member bar 31 and through an opening 32 extending through the cross member bar 31. A suitable knot 33 is tied in the cable member 29 at a predetermined position so that the cross member bar 31 will not slip downwardly on the cable 29 past the knot 33. After extending through the opening 32, an upwardly inclined portion 35 of the cable terminates at a loop 35*a* on a ring 34 and a downwardly inclined portion of the cable 36 terminates at a loop 36*a* on ring 34 and extends through another opening 37 extending through cross member bar 31 opposite the opening 32. A second knot 38 is tied in the cable member at another predetermined position so that cross member bar 31 remains substantially level when the swing is at rest and will not swing downwardly on the rope. Downwardly extending vertical portion 39 of the cable terminates in a second loop 40 through which the U-shaped connector 16 extends. Loop 40 may also be formed similar to the loop 30.

Referring to the upper portion of FIG. 1, hook member 41 is inserted through the ring 34 by reciprocally moving a spring biased closure pin 42 which is biased downwardly against a stop portion 43 on the hook member. Hook member 41 further includes an eye member 44 which is attached to the hook member through a swivel joint 45. Hook member 41 is a conventional type of connecting device which is well known in the art.

Figure 3:
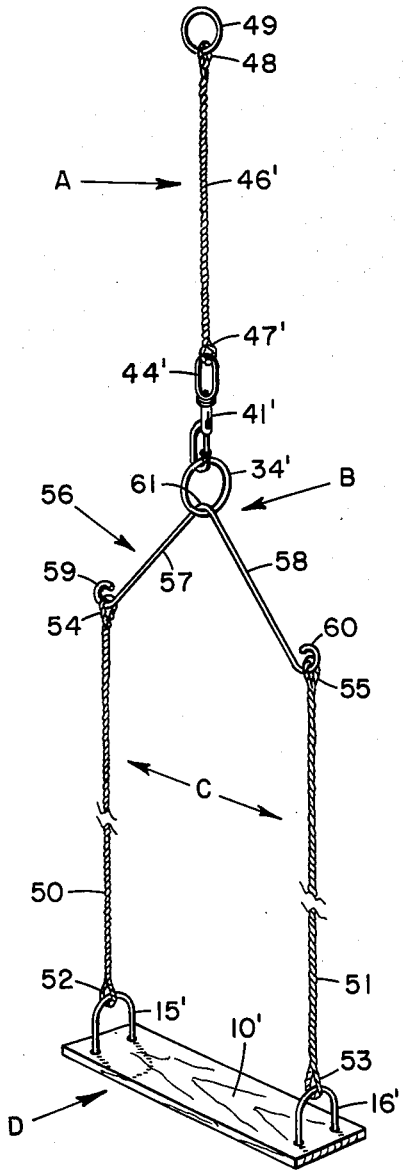
FIG. 3 is a perspective view of a second embodiment of the swing device of this invention.

Secured with the eye member 44 is a single cable 46 having a loop 47 through which the eye member 44 is connected. As best shown in FIG. 3 single cable 46' extends upwardly and terminates in a second loop 48 through which a ring 49 is inserted. The loops 47' and 48 are shown permanently attached to the ring number 44' and ring 49, respectively. However, it is possible to attach the ring number 44' and ring 49 to the rope 46' through other suitable means.

Referring to FIG. 3 of the drawing, a second embodiment of the swing apparatus of this invention is illustrated. Numerous components of the second embodiment are the same as those of the first embodiment and are identified with the same reference numerals with a prime designation to distinguish them. The swing apparatus of the second embodiment includes a seat member 10' which is identical to the seat number 10 and also includes U-shaped connector 15' and 16' which are also identical to U-shaped connectors 15 and 16. Instead of only two cables as shown in the first embodiment in FIG. 1, two upwardly extending spaced cables 50 and 51 having loops 52 and 53 respectively are used. U-shaped connector 15' is inserted to loop 52 and U-shaped connector member 16' is inserted through loop number 53. At the upper end of vertical cable 50 is a second loop 54 and at the upper end of vertical cable 51 is a loop 55.

The second embodiment shown in FIG. 3 also differs from that in FIG. 1 in that a V-shaped cross member 56 having legs 57 and 58 is substituted for the cable portions 35 and 36 and the cross member 31 of the embodiment shown in FIG. 1. The V-shaped cross member is preferably made up of high strength spring steel and includes curved hook portions 59 and 60 which form extensions of the legs 57 and 58, respectively. The hook portions 59 and 60 extend through the loops 54 and 55 respectively and serve to maintain the vertical cables 50 and 51 in a spaced parallel orientation about point 61 where the legs 57 and 58 of the V-shaped cross member 56 rests on the lower portion of the ring 34'.

The swing devices as depicted in FIGS. 1 and 3 function similarly and possess many of the same advantages. In particular, the device shown in FIG. 1 is particularly easy to manufacture. It can be constructed or fabricated from commonly found components such as cable, steel stock, lumber, etc., to provide a safe and amusing apparatus. As will be apparent, the use of the V-shaped upper cross members of the vertical spaced cables 29, 39, 59 and 51 enables a universal type movement of the swing seat relative to the support rope 46 or 46' due to the relative swing motion between the loops 35*a* and 36*a*, ring member 34' and hook member 41' in the case of the second embodiment. In addition the hook swivel 45 enables relative rotation of the swing seat relative to the upper mounting hook 48 without twisting of the cables 46 or 46'.

The member 56 and the cross bar 31 which form cross members maintain the two spaced side cables parallel so that an individual sitting in the seat 10 or 10' may grip the side cables. As will be apparent upon causing the swing to swing back and forth, rotation or relative movement of the seat will occur much more than would occur in a conventional type swing which merely uses two spaced side ropes attached to an upper support which is relatively stationary. The result is much more action for any individual using the swing device or this invention and more enjoyment thereof.

However, a controlled universal movement is provided to make the swing device safe in use while retaining much action. The spaced lower cables are maintained spaced to provide a safe, secure seat for a user. The swivel cross member means B gives controlled universal-type movement of the seat means. D. Hence, rotation of the seat means D may occur during use as well as angular movement of the parallel cables relative to the single cable. The length of the single cable is substantially the same length as parallel spaced cables to balance their relative movement to each other to provide the controlled universal movement to give much action within safety limits. This is also achieved through the rings 34, 34' and swivel hooks 41, 41'.

This high action of the swing apparatus A allows a user to exert himself which provides healthful exercise to control the degree of movement of the swing within its limits of controlled universal movement. The action includes rotation through swivel 41 and rocking through rings 34 and 34'. The flexibility of the cables allows additional action on their part.

While there has been shown and described preferred embodiments of the swing device in accordance with the invention, it will be appreciated that many changes and modifications may be made therein without however departing from the essential spirit of the invention within the scope of the claims.

We claim:

1. A swing apparatus for amusement and exercising, comprising:

a generally rectangular horizontal seat having two vertical, space parallel flexible cables secured thereo;

a cross bar member connected with the vertical cables to maintain the two cables spaced and parallel;

a ring means connected with the two cables;

a hook member having a spring biased closure pin for releasable receiving the ring means and an eye member attached to the hook member through a swivel joint;

a single vertical cable member having a first loop through which the eye member is connected and a second loop connected to a ring for supporting the swing apparatus;

the cross bar member having openings at opposite ends, for receiving one of the two spaced flexible cables in each of the openings;

the spaced flexible cables including a first cable secured with one side of the seat and extending upwardly through one of the openings in the cross bar member, and extending upwardly at an angle and secured to the ring means and a second cable secured to the ring means and extending downwardly at an angle to the cross bar member and downwardly to the other side of the seat and secured thereto;

the cables including knots therein just below the cross member bar openings to maintain the cross bar member horizontal at a predetermined position;

and the generally rectangular horizontal seat having inverted U-shaped connectors extending through openings at each side thereof for connecting the seat with the first and second cables; and said generally rectangular, horizontal seat having rectangular recesses on the lower seat surface for receiving reinforcing strap members that have the same general dimensions as the recesses and that are connected with the inverted U-shaped connectors.

* * * * *